US006311762B1

(12) United States Patent
Perrin et al.

(10) Patent No.: US 6,311,762 B1
(45) Date of Patent: Nov. 6, 2001

(54) METHOD AND DEVICE FOR CONTINUOUS METAL CHARGE CASTING

(75) Inventors: Eric Perrin, Metz; Cosimo Salaris, Montigny-les-Metz; Weisseldinger Edouard, Rombas, all of (FR)

(73) Assignees: Ascometal, Puteaux; Sogepass, Amneville; Ugine-Savoie Imphy, Ugine; Sollac, Puteaux, all of (FR); Societe Anonyme des Forges et Acieries de Dilling, Dilling Fed Rep (GB)

( * ) Notice: Subject to any disclaimer, the term of this patent is extended or adjusted under 35 U.S.C. 154(b) by 0 days.

(21) Appl. No.: 09/463,230

(22) PCT Filed: Jul. 21, 1998

(86) PCT No.: PCT/FR98/01599

§ 371 Date: Apr. 26, 2000

§ 102(e) Date: Apr. 26, 2000

(87) PCT Pub. No.: WO99/04918

PCT Pub. Date: Feb. 4, 1999

(30) Foreign Application Priority Data

Jul. 23, 1997 (FR) ..... 97 09351

(51) Int. Cl.[7] ..... B22D 11/10
(52) U.S. Cl. ..... 164/487; 164/444
(58) Field of Search ..... 164/415, 418, 164/459, 444, 487

(56) References Cited

U.S. PATENT DOCUMENTS 4,157,728 * 6/1979 Mitamura et la. ..... 164/4
5,325,910 * 7/1994 Schneider et al. ..... 164/472
5,676,195 * 10/1997 Vassilicos ..... 164/475
5,743,323 * 4/1998 Ohguro et al. ..... 164/415

FOREIGN PATENT DOCUMENTS 0 620 062-A1 * 10/1994 (EP) .
2 703 609 10/1994 (FR) .

* cited by examiner

*Primary Examiner*—Tom Dunn
*Assistant Examiner*—Lee Tran

(57) ABSTRACT

The invention concerns the adjustment of the linear distribution of an injected shearing fluid, during casting, through a slot (20) provided in the cooled metal body (1)—refractory riser block (14) interface of an ingot mold for continuous metal casting charge and emerging along said ingot inner periphery, the latter being provided with clamping means for adjusting the slot thickness. The invention is characterized in that it consists in "cold" injecting through said slot (20) a regulating inflammable fluid, which is ignited on its exit from the slot, and in acting on the clamping means (25, 26, 28, 29) such that the height of the flames (39) coming out of the slot (20) is substantially constant along the whole ingot inner periphery. The invention provides the advantage of an accurate and lasting adjustment of the injected flow rate without requiring the adjustment of the injection slot thickness. The invention is applicable to continuous steel charge casting in particular.

5 Claims, 1 Drawing Sheet

METHOD AND DEVICE FOR CONTINUOUS METAL CHARGE CASTING

TECHNICAL FIELD

The present invention relates to the hot-top continuous casting of metals, particularly steel. It relates more especially to the constituent components of the mould, their relative positioning having to be meticulously adjusted during set-up of the assembly.

BACKGROUND OF THE ART

Hot-top continuous casting may be seen as a development of conventional continuous casting, which is manifested by the fact that the meniscus (free surface of the cast metal) is pushed back upwards with respect to the level where the solidification of the metal against the cooled copper of the mould is initiated, whereas these two levels are virtually coincident in conventional continuous casting. This novel arrangement is obtained by placing, on the cooled copper part of the mould, a contiguous feed head made of thermally insulating refractory material, intended to contain the cast liquid metal and on the wall of which feed head any corresponding spurious solidification must be avoided. Consequently, the solidification of the cast metal can start correctly on the upper edge of this copper part. For this reason an inert gas (argon, for example) is injected along the first inner perimeter of the mould between the copper part and the feed head, in the form of jets intended to shear any undesirable solidified film which would have a tendency to be already formed in contact with the refractory feed head. This type of arrangement is described in document FR-A-2,703,609, the content of which is incorporated into the present specification by way of reference.

As taught by Patent Application FR-A-2,747,061, it is therefore advantageous for the bottom of the feed head to consist of a part made of a dense refractory having good mechanical strength, such as Sialon®. This part acts as a transition region between the cooled copper of the mould and the thermally insulating fibrous refractory of the feed head placed above it, which would degrade too rapidly if it were placed directly in contact with the upper edge of the cooled copper body, at the point where definite solidification of the cast metal starts. On the other hand, the risk of spurious premature solidification on this intermediate part is increased, but remains of no consequence because of the shearing gas blown into the interface with the copper, which interrupts the downward propagation of this undesirable process.

The stream of shearing gas is injected via a thin slot (a few tenths of a millimetre barely suffice), which is produced by compressing a bead of fibrous refractory material placed between the Sialon insert and the copper body of the mould. Using clamping means, the bead is compressed until the desired slot thickness is obtained, this being calibrated using controlled shims.

However, it proves to be necessary for correct execution of the casting process for there to be uniform distribution of the flow of gas around the inner perimeter of the mould. Now, despite every care that may be taken in controlling the slot thickness "when cold" (in the absence of cast metal), this good linear distribution is not in general correctly provided. Moreover, account cannot be taken of local disparities in the pressure drop at the copper/refractory interface, which disparities are associated, inter alia, with local variations in the microroughness of the two facing surfaces which define the injection slot. Furthermore, there is even less uniformity when operating "hot" (in the presence of cast metal) because of the phenomena of differential expansion of the materials involved.

SUMMARY OF THE INVENTION

The object of the present invention is to allow uniform linear distribution of the flow of shearing gas injected into the "refractory feed head/cooled metal body of the mould" interface by dispensing with having to adjust the thickness of the injection slot, and preserving this uniform distribution "when hot".

With this objective in mind, the subject of the invention is a process for adjusting the injection, during casting, of a fluid through an injection slot made at the "cooled metal body/refractory feed head" interface of a mould for the hot-top continuous casting of metals and emerging on the inner perimeter of this mould, the latter being provided with means for locally adjusting the thickness of the slot, which process is characterized in that, outside casting periods, an inflammable fluid is injected through the said slot, the fluid being ignited as it leaves the slot, and in that the said adjustment means are acted upon in such a way that the height of the flames leaving the slot is approximately constant around the inner perimeter of the mould.

As will have been understood, the basic idea behind the invention is that it is no longer a question of seeking to have a uniform slot thickness over the entire shearing-gas injection perimeter, but to have a uniform distribution of the flow of gas around this perimeter, this being manifested by a curtain of flames whose height at any point is adjusted.

The subject of the invention is also a device for implementing the process and intended for a mould for the hot-top continuous casting of metals having, made at the "cooled metal body/refractory feed head" interface, a slot for injecting a fluid which emerges around the inner perimeter of the mould, which device is characterized in that it comprises:

a line for feeding a fluid into the said injection slot, provided with a flow-regulating valve and with a supply selector which can be connected to the outlet of different fluid-supply sources; and elastic-clamping means making it possible to adjust the width of the injection slot around the inner perimeter of the mould.

BRIEF DESCRIPTION OF THE DRAWINGS

The invention will be fully understood and further aspects and advantages will be more clearly apparent in the light of the description which is given with reference to the appended single plate of drawings in which.

DETAILED DESCRIPTION OF THE PREFERRED EMBODIMENT

Figure 1:
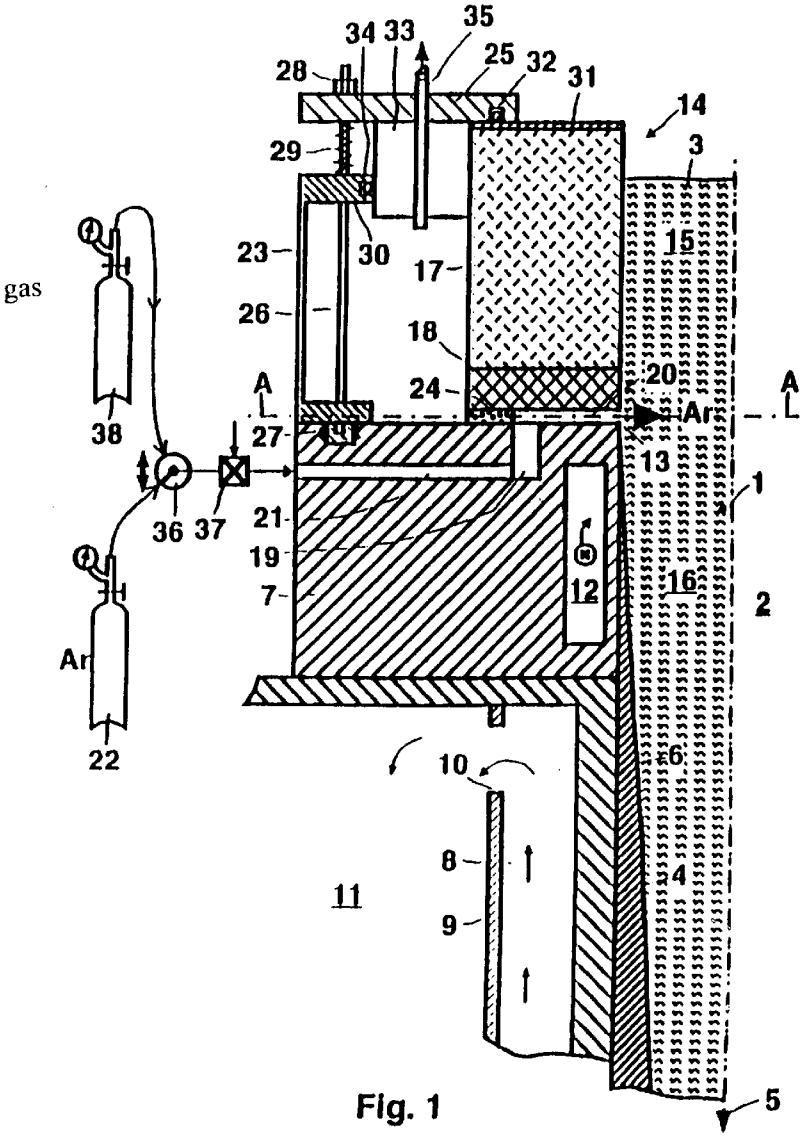
FIG. 1 shows schematically, seen in partial vertical cross section, the top of a mould for the hot-top continuous casting of steel in the so-called "hot" situation, that is to say during casting, and equipped with means for carrying out the invention.

In the figures, the same elements are represented by identical reference numbers.

As may be seen, the mould is composed of two contiguous stages 1 and 14, distinguished from each other in the figures by the horizontal line A—A and at the interface of which stages there is the shearing-gas injection slot 22.

The lower stage 1 constitutes the crystallizer. This is the so-called "active" part of the mould since it is there that the process of solidification of the cast metal, by massive extraction of heat, starts and progresses. This part, made of copper (or more generally a copper alloy), which is vigorously cooled by water circulation, has an internal passage 2 for the cast metal 3, in which passage the latter, on contact with the cooled metal walls, forms a solidified shell 4. Once this solidification has been correctly initiated, it continues progressively from the periphery towards the centre of the cast product, as long as the latter advances downwards within the mould in the extraction direction indicated by the arrow 5.

The crystallizer 1 is itself preferably formed from two superposed assemblies, namely a main tubular body 6 extended, at the top, by an auxiliary component 7 which is internally adjusted and aligned with the body 6 so as to present the cast product with an even and continuous passage.

The main body 6 conventionally consists, in the case of the casting of products of elongate cross section, such as slabs, of four contiguous plates joined together at right angles or, in the case of the casting of blooms or billets, of a monolithic tubular component. In all cases, this body 6, the inner surface of which is intended to come into contact with the cast metal, is vigorously cooled by circulation, against its outer face, of a sheet of water channelled through a vertical passage 8 made for this purpose by a jacket 9 placed a short distance from the said face. The jacket 9 has, at its ends, an upper opening 10 and a lower opening which bring the passage 8 into communication with a top discharge chamber 10 and a bottom injection chamber (not visible in the figures), respectively.

As regards the auxiliary component 7, this is formed by a ring cooled by internal circulation of water in a horizontal channel 12 made near the upper edge 13 on which the solidification of the cast metal is initiated. The essential function of the ring 7 is specifically to thermally protect this edge 13, which is subjected to very strong thermomechanical stresses during casting, by cooling it more effectively than can be done by the circuit for cooling the main tubular body 6 with a sheet of water.

The upper stage 14 consists of a feed head made of uncooled refractory material, the inner wall of which is also, and for reasons already explained, aligned with that of stage 1.

With regard to the casting process, it will merely be recalled here that the "cooled metal crystallizer 1 surmounted by the insulating refractory feed head 14" arrangement defines a calibrating passage for the cast metal 3, the upper portion 15 of which, bounded by the feed head, constitutes a buffer region for confining the hydrodynamic perturbations caused by the influx (not shown) of molten metal into the mould, and the portion 16 of which, which extends it downwards, is the region of solidification of the cast metal.

As may be seen, this refractory feed head 14 is also formed by two superposed contiguous separate components:

an upper sleeve 17 made of refractory material chosen for its thermally insulating properties, since it has to prevent any premature spurious solidification of the cast metal in the region 15. Preferably, a fibrous refractory will be chosen, for example the material sold under the name A 120K by the company Kapyrok; and a lower insert 18 made of a dense refractory material, chosen for its good mechanical integrity. This is because it has to withstand, near the crystallizer 1, the mechanical erosion of the tip of the solid shell 4 on the edge 13 of the ring 7, while the assembly is subjected to the usual vertical oscillation movement necessary for the casting operation, as well as to the thermomechanical stresses of a machine operating in thermal cycles imposed by the necessarily sequential nature of the casting process itself. A material such as SiAlON (Sialon®), advantageously doped with boron nitride, may be suitable.

The advantage of a feed head 14 in two superposed parts resides in the fact that it is possible to improve the mechanical integrity of the bottom part 18 subjected to a particularly severe environment in this regard near the edge 13. On the other hand, this strong lower insert 18 is inevitably less heat-insulating than the upper sleeve 17 made of fibrous refractory.

Thus, it is possible for a film of premature spurious solidification of cast metal to form on contact with its inner wall. This film is a significant, or even unacceptable, heterogeneous factor with regard to the process of controlled solidification that has to take place in the crystallizer 1. It is for this reason that it is advantageous, in accordance with a preferred embodiment of the hot-top casting described in document FR-A-2,703,609 already mentioned, to blow in an annular stream of gas into the base of the feed head 14 for the purpose of breaking any film of spurious solidification produced on the insert 18 and thus of allowing a sharp and even start of solidification of the cast metal on contact with the cooled metal ring 11.

For this purpose, a circuit for injecting a consumed inert gas (argon, for example) is provided between the feed head 14 and the crystallizer 7. This circuit comprises an annular slot 20 made at the "feed head/crystallizer" interface, emerging around the inner perimeter of the mould. At its other end, the slot is connected to a delivery chamber 19 supplied with argon via a calibrated duct 21, which is itself connected t a source of pressurized argon 22.

As may be seen, a sheet-metal construction 23 surrounds the feed head 14 a certain distance therefrom, thus defining with the latter a closed box allowing the risk of oxidation of the cast liquid metal inside the mould oxidizing by the oxygen in the air passing through the inevitably somewhat porous refractory mass 17.

A compressible bead 24 (made of fibrous refractory material, for example) serves as a spacer for adjusting the thickness of the slot 20. For this purpose, a clamping ring 25 makes it possible to compress this bead using elastic-clamping nuts 28 screwed onto the threaded free end of rods 26 held in anchoring studs 27 fixed into the insert 7. The desired elasticity of the clamping may be obtained, as may be seen by Belleville washers 29 stacked around the rods 26 under the ring 25 and bearing on an entrant return 30 of the sheet-metal structure 23 provided in its upper part. When the nuts 28 are screwed up, the inner periphery of the clamping ring 25 bears, via a compression O-ring 32, on the upper face of the feed head 14 coated for this purpose with a protective mechanical sheet 31.

In this case, the box surrounding the feed head 14 is closed in its upper part, facing the clamping ring 25, by means of an annular plug 33 fastened under the said ring, the size of which plug is adjusted in order to be able to occupy the opening left between the return 30 and the feed head 17.

An O-ring seal 34 is provided in a groove made on the inner edge of the return 30 in order to allow the plug 33 to be able to slide freely during the adjustments. A vent 35, with an outlet (not shown) which can be closed off, is advantageously provided through the plug 33 and the ring 25 in order to allow the box to be purged as will be explained below.

As may be seen in FIG. 1, during casting of the metal 3, a flow of shearing argon is blown into the mould at the "feed head 14/crystallizer 1" interface through the slot 20. The latter is therefore supplied by the source 22 via an inlet line comprising a "two-way" selector 36 followed by a flow regulator 37.

The "two-way" selector 36 has the function of being able to switch between choosing the argon source 22 used during casting or choosing an ancillary source 38 containing an inflammable combustible fluid that is injected via the slot 20 during periods between casting runs in accordance with the invention. This inflammable fluid is, for example, natural gas.

Figure 2:
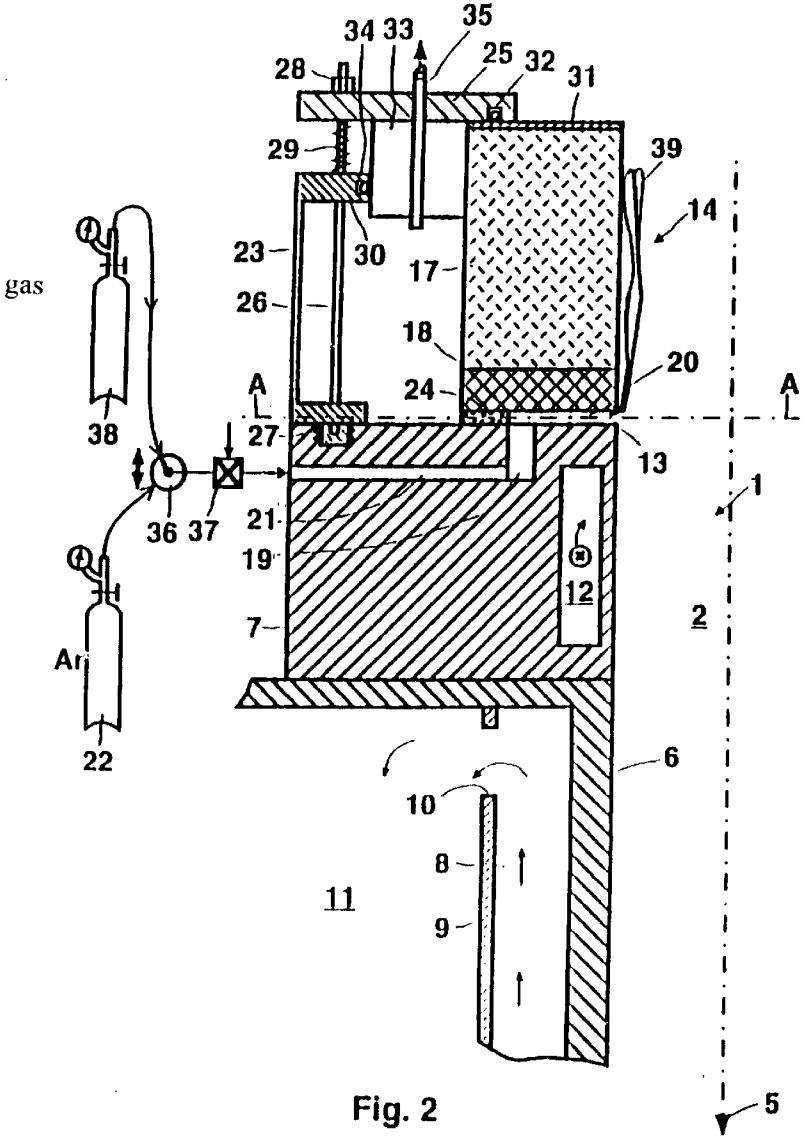
FIG. 2, similar to FIG. 1, shows the situation of the mould "when cold", that is to say containing no metal to be cast, at a moment before the casting run, when the adjustments to the distribution of the flow of shearing gas are carried out in accordance with the invention.

As illustrated in FIG. 2, the "cold" situation is advantageously used to start by setting the thickness of the slot 20 to a value of a few tenths of a millimetre, for example 0.2 mm, by compressing the bead-spacer 24 to a greater or lesser extent using the clamping ring 25, as set out previously. With the selector 36 being in the position shown in FIG. 2, inflammable fluid from the source 38 is then injected via the slot 20 with a flow rate, which is low at first, controlled by the regulating valve 37. This gas is ignited in the air at the outlet of the slot 20. The latter is then used in the manner of a burner which produces a curtain of flames 39 around the inner perimeter of the mould, the height of the flames being able to be varied depending on the position according overall to the local flow rate of fuel which leaves the slot at right angles to the position in question. The distribution of the flow of inflammable fluid around this perimeter is then adjusted by acting on the clamping nuts 28 until the height of the flames 39 is approximately constant all around the perimeter as for the opening of the valve 37 is adjusted to allow a flame height of a few centimetres. This is because experience shows that a flame height of 2 to 3 cm is sufficient to then ensure a satisfactory flow of shearing argon through the slot 20 thus adjusted.

In this operation, it is therefore no longer sought to make the thickness of the slot 20 constant all around the injection perimeter, but to have linear homogeneity of the flow of shearing gas around this perimeter, which homogeneity is manifested by a flame height. It will be noted that the use of an elastic clamping mechanism 29-28, 26 makes it possible to maintain, in the presence of cast steel (FIG. 1), the setting defined "when cold" (FIG. 2). The invention thus makes it possible to take into account the various expansions of the various materials involved in the manufacture of the mould.

Moreover, it will also be noted that the ducts and the sealed box surrounding the feed head 14 is systematically "rinsed" by injecting argon by means of the purge system shown by the vent 35 which makes it possible to ensure that there are no traces of inflammable fluid possibly remaining in the box.

Furthermore, the invention has the additional advantage of being able to ensure that the complete injection circuit is sealed "when cold". To do this, during injection of the inflammable fluid, a flame may be manually moved all along the circuit. The slightest possible leak is then immediately detected.

It goes without saying that the invention is not limited to the above-described example, but many alternative and equivalent embodiments as long as its definition given by the following claims is respected. In particular, the term "slot" used for describing the injector for expelling the shearing gas into the mould should be understood to mean both a slot which is continuous around the perimeter and a discontinuous slot, and therefore also a series of calibrated orifices distributed around the inner perimeter of the mould and provided with means for adjusting the pressure drops thereat.

What is claimed is:

1. A process for adjusting the injection, during casting, of an inflammable fluid through an injection slot made between a cooled metal body and a refractory feed head interface of a mold for a hot-top continuous casting of metals and emerging around an inner perimeter of said mold, the latter being provided with means for adjusting the thickness of said slot, in which the process comprise the steps of:

injecting said inflammable fluid through said slot, igniting said inflammable fluid as it leaves said slot, wherein adjustment means are acting upon in such a way that the height of the flames leaving said slot is approximately constant around said inner perimeter of said mold.

2. Process according to claim 1, characterized in that natural gas is used as the inflammable fluid to be injected.

3. Process according to claim 1 characterized in that it is applied to a mould for the hot-top continuous casting of steel.

4. Device of implementing the process according to claim 1 and intended for a mold for a hot-top continuous casting of metals having, made between a cooled metal body and a refractory feed head interface, a slot for injecting an inflammable fluid which emerges around an inner perimeter of said mold, in which said device is characterized in that it comprises:

a line for feeding said inflammable fluid into said injection slot, provided with a flow regulating valve and with an injection selector which is connected to the outlet of different fluid supply sources; and elastic clamping means allowing the width of said injection slot to be adjusted around said inner perimeter of said mold.

5. Device according to claim 4 characterized in that it comprises means for ensuring that the circuits for injecting fluid into the mould are purged.

* * * * *